US009062514B2

(12) United States Patent
Scranton et al.

(10) Patent No.: US 9,062,514 B2
(45) Date of Patent: Jun. 23, 2015

(54) DOWNHOLE VALVE

(71) Applicant: Schlumberger Technology Corporation, Sugar Land, TX (US)

(72) Inventors: Joseph D. Scranton, Missouri City, TX (US); Kamil Ifitkhar, Sugar Land, TX (US); Colin Longfield, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/969,100

(22) Filed: Aug. 16, 2013

(65) Prior Publication Data

US 2013/0327539 A1 Dec. 12, 2013

Related U.S. Application Data

(62) Division of application No. 12/575,999, filed on Oct. 8, 2009, now abandoned.

(51) Int. Cl.

| | |
|---|---|
| ***E21B 34/06*** | (2006.01) |
| ***E21B 34/00*** | (2006.01) |
| ***E21B 34/10*** | (2006.01) |

(52) U.S. Cl.

CPC ..... *E21B 34/06* (2013.01); *E21B 34/10* (2013.01)

(58) Field of Classification Search

CPC ..... E21B 34/14; E21B 34/06; E21B 43/12; E21B 34/08; E21B 21/10

USPC ..... 166/373, 374, 319, 320

See application file for complete search history.

(56) References Cited

U.S. PATENT DOCUMENTS

| | | | | |
|---|---|---|---|---|
| 4,113,012 | A | | 9/1978 | Evans et al. |
| 4,467,867 | A | | 8/1984 | Baker |
| 4,537,258 | A | | 8/1985 | Beck |
| 4,664,196 | A | | 5/1987 | Manke |
| 4,665,991 | A | * | 5/1987 | Manke ..... 166/373 |
| 4,691,779 | A | * | 9/1987 | McMahan et al. ..... 166/321 |
| 4,736,798 | A | * | 4/1988 | Zunkel ..... 166/321 |
| 4,796,699 | A | * | 1/1989 | Upchurch ..... 166/250.17 |
| 5,050,681 | A | * | 9/1991 | Skinner ..... 166/374 |
| 5,193,619 | A | | 3/1993 | Edwards et al. |
| 5,209,303 | A | * | 5/1993 | Barrington ..... 166/374 |
| 5,240,072 | A | | 8/1993 | Schultz et al. |
| 5,259,456 | A | | 11/1993 | Edwards et al. |
| 5,318,130 | A | | 6/1994 | Manke |
| 5,558,162 | A | * | 9/1996 | Manke et al. ..... 166/319 |
| 5,597,016 | A | | 1/1997 | Manke et al. |

(Continued)

FOREIGN PATENT DOCUMENTS

EP 227353 A2 7/1987

*Primary Examiner* — Kenneth L Thompson
*Assistant Examiner* — Michael Wills, III
(74) *Attorney, Agent, or Firm* — Patrick Traister; Brandon Clark; Jeffery Peterson

(57) ABSTRACT

A tool that is usable with a well includes a valve element, a mechanical operator, a pressure chamber and a regulator. The valve element has a first state and a second state. The mechanical operator responds to a predetermined signature in an annulus pressure relative to a baseline level of the annulus pressure to transition the valve element from the first state to the second state. The pressure chamber exerts a chamber pressure to bias the mechanical operator to transition from the second state to the first state. The baseline level is capable of varying over time, and the regulator regulates the chamber pressure based on the baseline level.

18 Claims, 5 Drawing Sheets

(56) References Cited

U.S. PATENT DOCUMENTS

| | | | | | |
|---|---|---|---|---|---|
| 5,791,414 | A | | 8/1998 | Skinner et al. | |
| 5,826,660 | A | * | 10/1998 | Rytlewski | 166/373 |
| 5,918,688 | A | | 7/1999 | Evans | |
| 5,984,014 | A | | 11/1999 | Poullard et al. | |
| 6,145,595 | A | * | 11/2000 | Burris, II | 166/374 |
| 6,182,764 | B1 | * | 2/2001 | Vaynshteyn | 166/373 |
| 6,209,663 | B1 | | 4/2001 | Hosie | |
| 6,328,055 | B1 | * | 12/2001 | Burris, II | 137/68.23 |
| 6,536,529 | B1 | * | 3/2003 | Kerr et al. | 166/375 |
| 7,624,792 | B2 | | 12/2009 | Wright et al. | |
| 8,443,894 | B2 | | 5/2013 | Coghill et al. | |
| 2003/0155131 | A1 | | 8/2003 | Vick, Jr. | |
| 2006/0169462 | A1 | | 8/2006 | Bishop et al. | |
| 2010/0200245 | A1 | | 8/2010 | Ringgenberg et al. | |

* cited by examiner

DOWNHOLE VALVE

This application is a divisional application of U.S. application Ser. No. 12/575,999, filed on Oct. 8, 2009.

BACKGROUND

This disclosure generally relates to a downhole valve.

Hydrocarbon fluid (oil or gas) typically is communicated from a subterranean well using a pipe, called a "production string." The production string extends through a wellbore that is drilled through the producing formation and may include various valves for purposes of controlling the production of the hydrocarbon fluid. One such valve is a ball valve that may be operated for purposes of controlling the flow of the hydrocarbon fluid through the central passageway of the production string. Another valve that is typically part of a production string is a circulating valve, a valve that is operated to control the flow of the hydrocarbon fluid between the central passageway and the region outside of the string, called the "annulus."

A well may be in an underbalanced state, a state in which the pressure that is exerted by the formation is greater than the hydrostatic pressure that is exerted by the fluid in the annulus. One type of circulating valve that is used in an underbalanced well has a series of check valve elements through which well fluid is circulated for purposes of opening and closing the valve. A potential challenge in using such a circulating valve is that typically, the central passageway of the production tubing string above the valve must be filled with fluid in order to properly operate the valve.

Another type of conventional circulating valve is remotely operated by communicating stimuli (pressure pulses, for example) into the fluid in the annulus near the valve. A sensor (a pressure sensor, for example) of the circulating valve detects the stimuli, and electromechanics of the valve typically decode commands from the stimuli and operate the valve accordingly. Although there is no requirement that the central passageway be filled with fluid for purposes of operating this type of circulating valve, the valve typically is not suitable for use in a high pressure high temperature (HPHT) environment due to temperature limitations of the valve.

SUMMARY

In an embodiment of the invention, a tool that is usable with a well includes a valve element, a mechanical operator, a pressure chamber and a regulator. The valve element has a first state and a second state. The mechanical operator responds to a predetermined signature in an annulus pressure relative to a baseline level of the annulus pressure to transition the valve element from the first state to the second state. The pressure chamber exerts a chamber pressure to bias the mechanical operator to transition from the second state to the first state. The baseline level is capable of varying over time, and the regulator regulates the chamber pressure based on the baseline level.

In another embodiment of the invention, a tool that is usable with a well includes a valve element having a first state and a second state. The tool includes a spring, a pressure chamber and a mechanical operator. The mechanical operator responds to forces exerted in concert by the spring and the pressure chamber to bias transitioning of the valve element from the first state to the second state, and the mechanical operator responds to annulus pressure to transition the valve element from the second state to the first state.

In yet another embodiment of the invention, a tool that is usable with a well includes a valve element, a first mechanical operator, a pilot valve and a second mechanical operator. The valve element has a first state and a second state. The pilot valve controls communication of an annulus pressure to the first mechanical operator; and the second mechanical operator responds to the annulus pressure to control operation of the pilot valve. The second mechanical operator is adapted to cause the pilot valve to communicate the annulus pressure to the first mechanical operator to cause the first mechanical operator to transition the valve element from the first state to the second state in response to the annulus pressure exhibiting a predetermined signature and otherwise block the communication of the annulus pressure to the first mechanical operator to cause the first mechanical operator to transition the valve element from the second state to the first state.

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
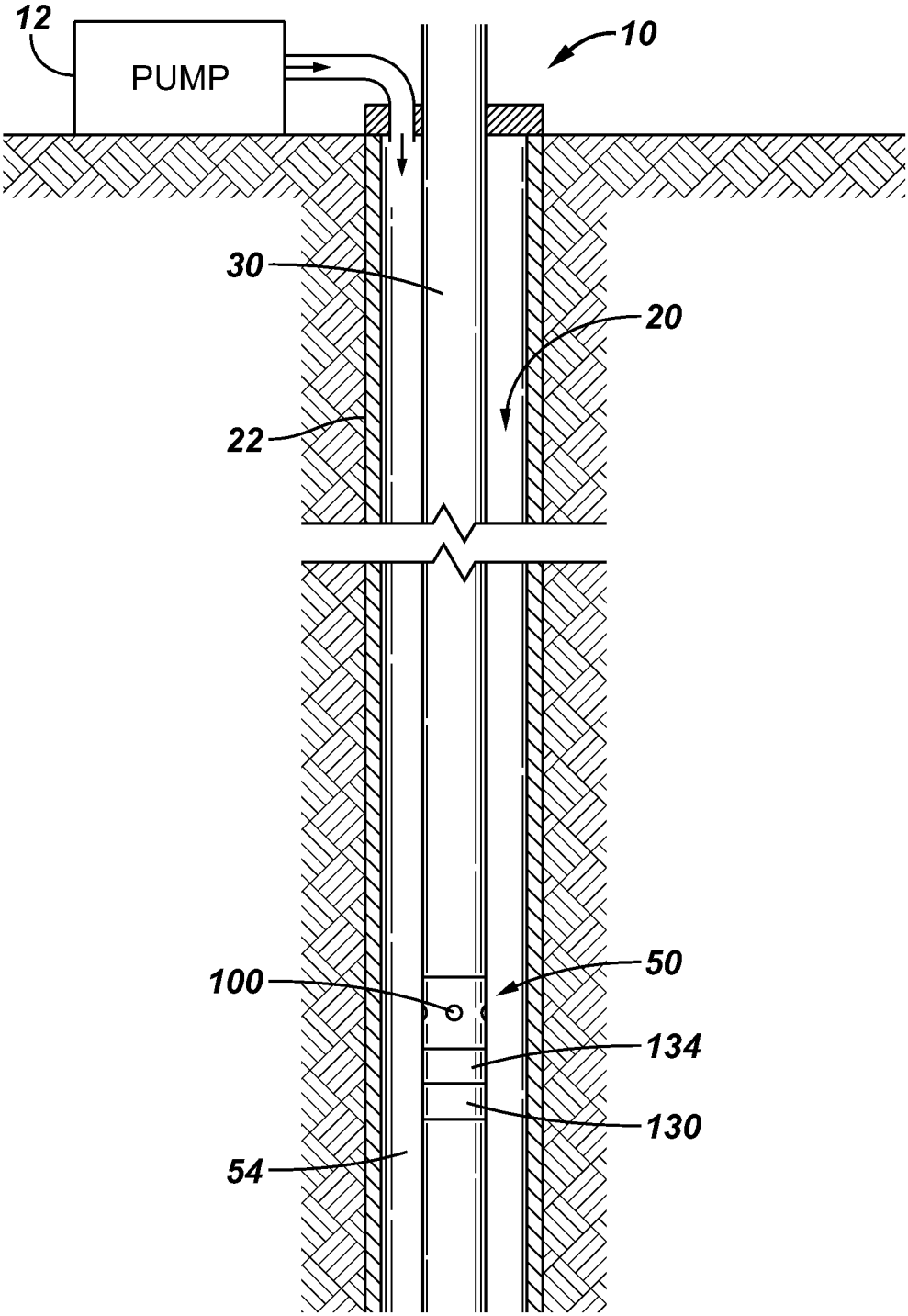
FIG. 1 is a schematic diagram of a subterranean well according to an example.

Referring to FIG. 1, in accordance with an example, a well 10 includes a wellbore 20, which may be lined with a casing string 22 that supports the wellbore 20. As other examples, the wellbore 20 may be only partially cased by a wellbore or may be entirely uncased. A tubular string 30 extends downhole into the wellbore 20 through one or more production or injection zones of the well 10 for purposes of facilitating the production of fluids from the well 10 and/or the injection of fluids into the well 10. It is noted that although FIG. 1 depicts the string 30 as being disposed in a main vertical wellbore, the wellbore 20 may be a lateral wellbore, in accordance with other examples. Furthermore, although FIG. 1 depicts a subterranean terrestrial well, the systems, techniques, tools and systems that are described herein may likewise be applied to subsea wells.

In general, the string 30 includes at least one valve assembly, such as a circulating valve tool 50 that is depicted in FIG.

1. For purposes of example, the tool 50 may be a multiple cycle tool, which means that the tool 50 is constructed to be opened and closed numerous times. It is noted that the string 30 may includes other types of valve assemblies (a ball valve assembly, for example), which may employ the control systems and techniques that are disclosed herein, in accordance with other examples.

For the following example, it is assumed that the well 10 is an underbalanced state, although this condition is not a prerequisite for the use of the tool 50. In the underbalanced state, the pressure that is exerted by the formation is greater than the hydrostatic pressure that is exerted by the fluid in an annulus 54, which is the annular region of the well 10 between the borehole wall or well casing string 22 (depending on whether the well 10 is cased or uncased) and the exterior of the tool 50. In general, the tool 50 is operated by manipulating a pressure in the annulus 54. As examples, the annulus pressure may be manipulated using a surface-disposed pump 12, although other systems and techniques may be used to induce pressure fluctuations in the annulus 54 for purposes of controlling the tool 50, as can be appreciated by one of skill in the art.

To operate the tool 50, pressure stimuli may be communicated from the surface of the well 10 downhole into the annulus 54 for purposes of delivering a command to the tool 50, such as a command to open fluid communication through radial ports 100 of the tool 50 or a command to close the fluid communication through the radial ports 100 to isolate the annulus 54 from the central passageway of the string 30, as non-limiting examples. As more specific examples, the communication of the pressure stimuli may involve momentarily increasing the pressure in the annulus 54 above a baseline annulus pressure level; momentarily decreasing the annulus pressure below the annulus baseline pressure level; a series of annulus pressure increases or decreases; etc.

In one control scheme, a sequence of pressurization cycles may be applied to the annulus 54 to operate the tool 50. The pressurization cycles may include cycles (called "up cycles") in which the annulus pressure is increased and cycles (called "down cycles") in which the annulus pressure is relaxed or decreased back to the annulus baseline level. In this manner, a particular number of up and down pressurization cycles may be used for purposes of transitioning the tool 50 from its closed state to its open state, and vice versa.

As described herein, the tool 50 includes a mechanical operator 130, which responds to the fluid pressure in the annulus 54. Unlike conventional arrangements, the actuation of the mechanical operator 130 does not depend on whether a full column of fluid exists in the central passageway of the string 30, and the operation of the mechanical operator does not involve circulating well fluid through the tool 50. Instead, as described herein, the tool 50 communicates the annulus pressure to the mechanical operator 130 for purposes of transitioning the tool 50 from a first state (an open or closed state, as non-limiting examples) to a different, second state (an open or closed state, as non-limiting examples).

As further described herein, a gas chamber 134 of the tool 50 exerts a force to counter the force that is produced by the annulus pressure (e.g., to bias the tool 50 to remain in the first state or return to the first state from the second state). The tool 50 has features to compensate the force that is exerted by the gas chamber 134 for purposes of causing this force to track the baseline pressure level of the annulus. In this way, the gas chamber accommodates downhole pressure and temperature fluctuations, which may otherwise adversely affect the operation of the tool 50.

Figure 2:
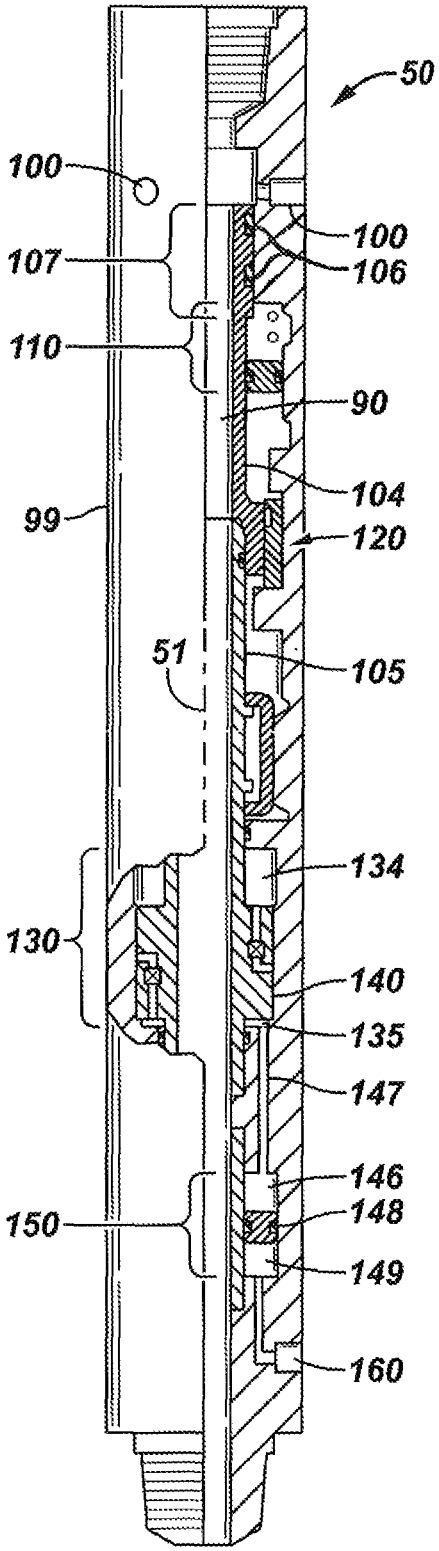
FIG. 2 is a schematic diagram of a circulating valve tool according to an example.

FIG. 2 depicts a partial cross-sectional view of the tool 50, in accordance with a non-limiting example. Although FIG. 2 depicts a simplified, right-hand cross-sectional view of the tool 50 (on the right hand side of a longitudinal axis 51 of the tool 50), as can be appreciated by one of skill in the art, the tool 50 is generally symmetrical about the longitudinal axis 51, with the corresponding mirroring left-hand cross-section generally not being depicted in FIG. 2.

Referring to FIG. 2 in conjunction with FIG. 1, the tool 50 includes a generally tubular outer housing 99, which is generally coaxial with the longitudinal axis 51 and is designed to connect in line with the string 30. The outer housing 99 includes a central passageway 90 that is in fluid communication with the corresponding central passageways of the string sections above and below the valve assembly 50. The tool 50 includes a circulating valve element 107, which includes the radially-disposed flow ports 100, which are formed in the housing 99.

In the open state of the circulating valve element 107 (and tool 50), fluid communication is established between the annulus 54 (see FIG. 1) and the central passageway 90 through the flow ports 100. In this open state, an internal sleeve 104 of the circulating valve element 107 is in its downward position of travel (as depicted in FIG. 2), which means that the flow ports 100 are above the highest o-ring 106 on the sleeve 104 (i.e., the sleeve 104 and its associated o-rings do not block the radial flow).

For the closed state (not depicted in FIG. 2) of the valve element 107 (and tool 50), the sleeve 104 is near or at the uppermost point of travel such that the flow ports 100 are disposed between the o-rings 106 to therefore block fluid communication between the central passageway 90 and the annulus 54.

The up and down travel of the sleeve 104 is controlled by the mechanical operator 130 of the tool 50. In general, the operator 130 includes a piston head 140, which is connected through a mandrel 105 to the sleeve 106. In general, the piston head 140 is concentric with the sleeve 104 and has a central passageway to form part of the central passageway 90 of the tool 50. The piston head 140 moves up and down in response to a pressure differential between upper and lower gas chambers: the gas chamber 134 (called the "upper chamber 134" below), which exerts a downward force on an upper surface of the piston head 140 and a gas chamber 135 (called the "lower chamber 135" below), which exerts an upward force on a lower surface of the piston head 140. The upper 134 and lower 135 chambers reside inside a corresponding annular recess of the housing 99.

The volumes of the upper 134 and lower 135 gas chambers are variable in that the volume of the upper chamber 134 is maximized and the volume of the lower chamber 135 is minimized (as depicted in FIG. 2) in the open state of the tool 50; and the volume of the upper chamber 134 is minimized, and the volume of the lower chamber 135 is maximized in the closed state of the valve 50. The upper 134 and lower 135 chambers contain an inert gas (Nitrogen, for example); and the differential pressure between the upper 134 and lower 135 chambers control the upward and downward movement of the piston head 140, and thus, control the upper and downward movement of the sleeve 104. The lower chamber 135 is in fluid communication with another gas chamber 146 via a gas passageway 147.

The gas chamber 146 is part of a compensator 150, which transfers the annulus pressure to the gas chamber 146 while isolating the gas chamber 146 from the well fluid in the annulus 54. More specifically, the compensator 150 includes a floating compensating piston 148, which resides in an annular recess of the housing 99 to form the gas chamber 146 above the piston 148 and a chamber 149 below the piston 148, which receives annulus fluid communicated from one or more radially-disposed ports 160 (one port being shown in FIG. 2) that are formed in the outer housing 99. Thus, in general, via the ports 160, well fluid enters the chamber 149 and exerts upward pressure on the compensating piston 148. In response to this pressure, the compensating piston 148 pressurizes the gas in the gas chamber 146, which in turn, produces an upward force on the piston head 140.

As described in more detail below, a valve control network is built into the piston head 140 to allow equalization of pressures between the upper 134 and lower 135 gas chambers. However, the equalization occurs at a controlled rate for purposes of permitting pressure differentials to develop to act on the piston head 140. More specifically, the flow rate between the gas chambers 134 and 135 is initially limited when the annulus pressure first changes with respect to its steady state baseline pressure level. This limited flow rate, in turn, produces a set upward or downward force on the piston head 140.

For example, in response to an increase in annulus pressure, the pressure in the chamber 135 exceeds the pressure in the chamber 134 to cause an upward force on the piston head 140. As the piston head 140 moves upwardly, the pressures between the chambers 134 and 135 equalize to create a balanced condition after the piston head 140 is shifted to an upper position.

When the annulus pressure subsequently decreases, a downward force is initially produced on the piston head 140 due to the momentary differential pressure. Due to the valve system in the piston head 140, the pressures generally equalize so that when the piston head 140 reaches a point near its lowermost position of travel (as depicted in FIG. 2), a balanced condition once again rises. Due to the above-described pressure balancing, the gas pressure in the tool 50 adjusts to the baseline annulus pressure level; and as such, the gas charge is compensated for shrinkage or expansion due to thermal changes and changes in the annulus pressure.

Among the other features of the tool 50, in accordance with some examples, the tool 50 includes an indexer 110 to control the sequence of annulus pressurization cycles for purposes of causing the tool 50 to change states. As a non-limiting example, the indexer 110 may be a J-slot mechanism, in which a pin on the operator mandrel 105 traverses a J-slot that has a predetermined pattern that restricts the travel of the operator mandrel 105 until the end of the pattern is reached. In other words, the J-slot establishes a predetermined number up/down pressurization cycles that must occur before the tool 50 transitions from a closed state to an open state. Once at the end of the pattern, the indexer 110 may be reset by releasing pressure on the annulus to move the operator mandrel 105 back to its lowermost point of travel to close the tool 50.

The tool 50 may include a mechanism 120 to restrict all motion of the operator mandrel 105 until a predetermined force on the piston head 140 (and operator mandrel 105) builds up. This allows the pressure differential across the piston head 140 to increase to a predetermined threshold before the operator mandrel 105 shifts for purposes of increasing the tool shifting speed to avoid leaving the tool 50 in an undesirable mid state (never fully opened or fully closed, for example). In accordance with some examples, the mechanism 120 may be a collet, which includes a plurality of fingers that engage corresponding features on the operator mandrel 105 to secure the operator mandrel 105 in place until the predetermined force threshold is reached. The fingers on the collet hold the operator mandrel 105 in its original position until the pressure differential across the piston head 140 is sufficiently high to overcome the grasp of the collet fingers and quickly shift the operator mandrel 105 all the way to the end position.

Figure 3:
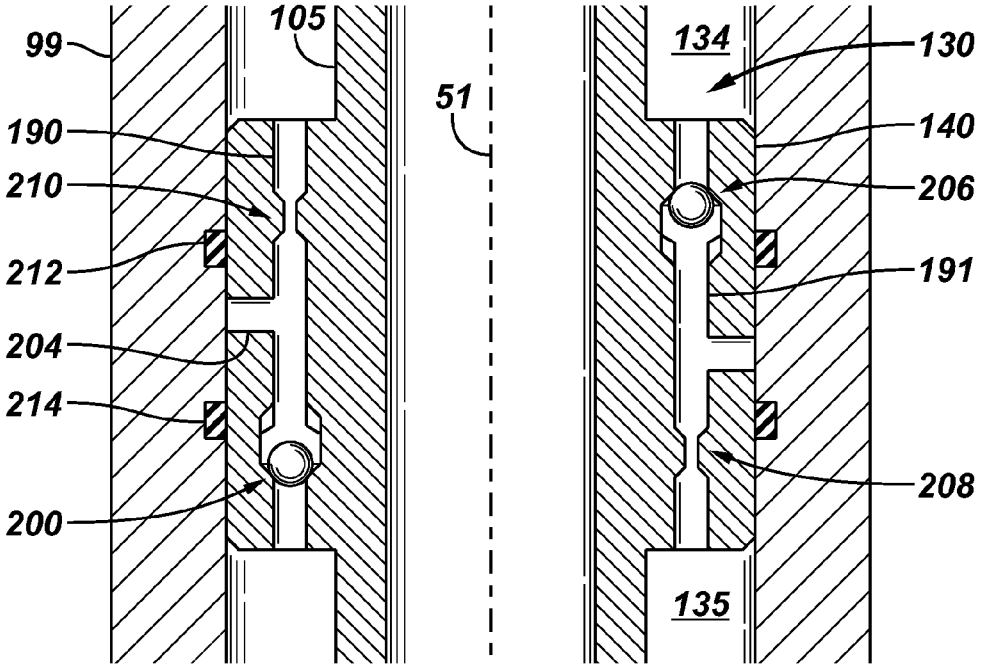
FIG. 3 is a more detailed cross-sectional view of a mechanical operator section of the tool of FIG. 2 according to an example.

Referring to FIG. 3, the piston head 140 may include an embedded valve system, which includes a first flow path 190 for purposes of communicating gas pressure from the lower chamber 135 to the upper chamber 134. This flow path includes a flow restrictor 210 and a check valve 200. In this arrangement, when the pressure in the lower chamber 135 exceeds the pressure in the upper chamber 134, the check valve 200 opens to permit a bleed flow between the chambers 134 and 135. The flow restrictor 210 ensures that the flow rate is relatively small to create a pressure differential to produce an upward force on the piston head 140. After the piston head 140 has traveled upwardly by a sufficient distance, a radial crosshole 204, which is in communication with the above-described communication path bypasses a seal that is created by an upper o-ring 212 to bypass the flow restrictor 210 and allow relatively fast equalization of the pressure between the upper 134 and lower 135 chambers.

In a similar arrangement, a metered flow path 191 is disposed in the piston head 140 for purposes of equalizing pressures in the chambers 134 and 135 for the scenario in which the lower chamber 135 is de-pressurized due to a decrease in the annulus pressure. This flow path 191 includes a flow restrictor 208 and a check valve 206, which is constructed to open to allow communication through the flow restrictor 208 between the chambers 134 and 135 when the pressure in the upper chamber 134 is greater than the pressure in the lower chamber 135. Due to the metering by the flow restrictor 208, a downward force is created while the pressures in the chambers 134 and 135 are being equalized. After the piston head 130 has traveled downwardly by a sufficient distance, a cross hole 207, which is in communication with the passageway travels past the seal created by a lower o-ring 214 to therefore bypass the flow restrictor 208 to allow relatively rapid equalization of the chamber pressures.

Thus, due to the above-described valve system in the piston head 140, the pressure in the upper chamber 134 tracks the baseline pressure level in the annulus 54 to compensate its gas pressure for shrinkage or expansion due to thermal changes and changes in the annulus pressure.

Figure 4:
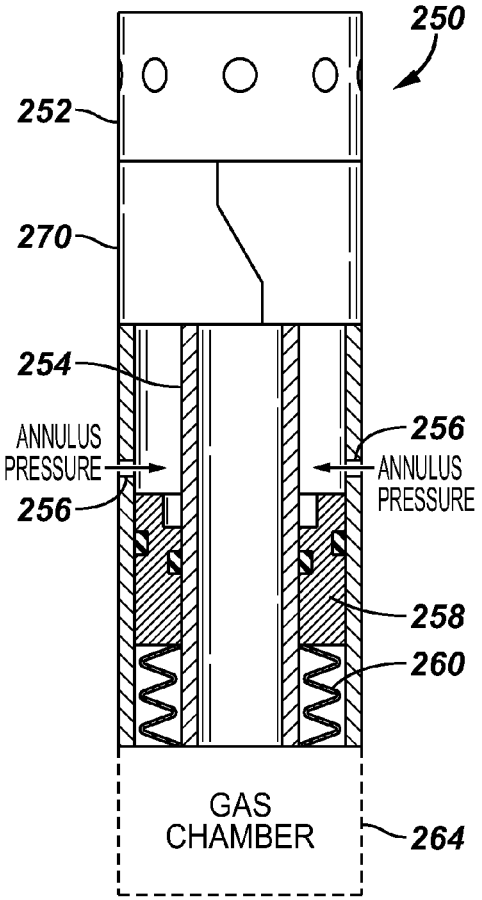
FIGS. 4 and 5 are schematic diagrams of other examples of circulating valve tools.

FIG. 4 depicts a circulating valve tool 250 in accordance with other another example. Similar to the tool 50, the tool 250 includes a mechanical operator that responds to pressure changes in the annulus 54, without requiring a full column of fluid in the tubing string and without requiring circulation of well fluid through the tool 250. However, unlike the tool 50, the tool 250 does not use a gas chamber that equalizes its pressure with the baseline annulus pressure. Instead, the tool 250 includes a gas chamber 264 that has a fill port to store a predetermined charge of inert gas (Nitrogen gas, for example), which is used for purposes of operating a circulating valve element 252 of the tool 250.

More specifically, the combination of pressure from the gas chamber 264 and a spring 260 (a Belleville spring or bellows spring, as non-limiting examples) produces an upward force on a power piston head 258. The power piston head 258, in turn, is connected by way of an operator mandrel 254 to the circulating valve element 252. As also shown in FIG. 4, the tool 250 may include an indexer 270 to establish a predefined up and down transition cycle in order to change the state of the circulating valve 252. The upper surface of the piston 258 is exposed through radial ports 256 to the annulus pressure. Therefore, the piston 258 moves downwardly in response to increasing pressure in the pressure stimuli, and when the pressure relaxes, the upward force provided by the compressed spring 260 and the gas pressure exerted by the gas chamber 264 produce a force in concert to move the piston 258 in an upward direction.

Other variations are contemplated and are within the scope of the appended claims. For example, the valve assembly 250 may include a retention mechanism, such as the above-described collet, for purposes of storing energy and ensuring a fast valve opening, which avoids half states and overcomes the effects of erosion.

Figure 5:
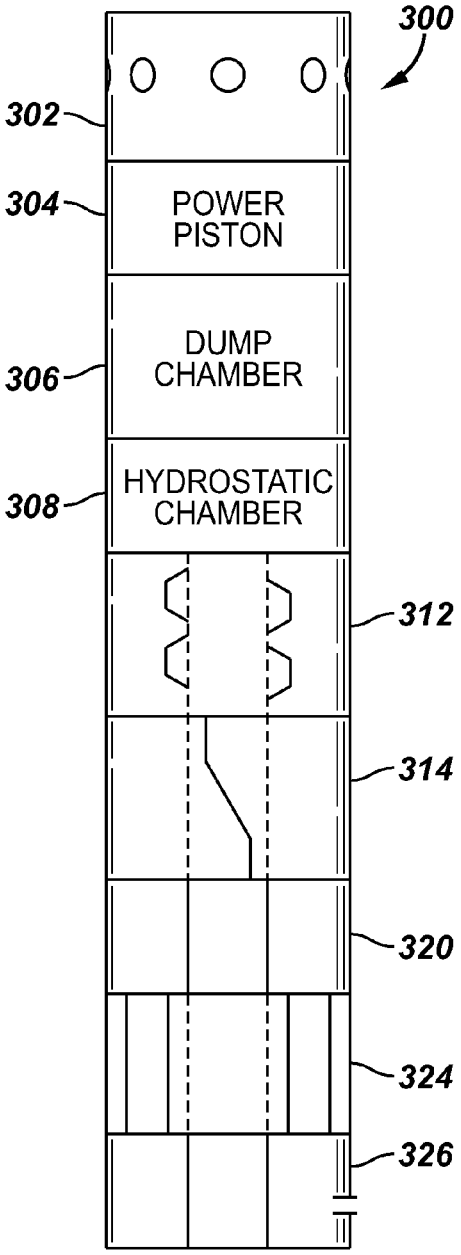

FIG. 5 depicts a circulating valve tool 300 in accordance with another example. The tool 300 has a similar design, in some aspects, relative to the tool 50, in that the tool 300 has upper 320 and lower 326 gas chambers, an operator piston 324 and indexer 314, similar in design to the upper 134 and lower 135 gas chambers, piston 130 and indexer 110, respectively, of the tool 50. In this regard, the lower gas chamber 326 has pressure that is derived by a compensator from the annulus pressure (not depicted in FIG. 5). However, unlike the tool 50, the valve assembly 300 does not use the gas pressure to drive an operator mandrel for purposes of opening and closing a circulating valve element 302 of the tool 300. Instead, the tool 300 uses the annulus pressure for purposes of operating the circulating valve element 302.

More specifically, the piston 324 may be connected to operator a pilot valve 312, which controls the application of annulus pressure to a power piston 304, which, in turn, operates the circulating valve 302. As shown in FIG. 5, the system to control the power piston 304 includes a pilot valve 312 (connected to the piston 324), a hydrostatic chamber 308 and a dump chamber 306.

Figure 6:
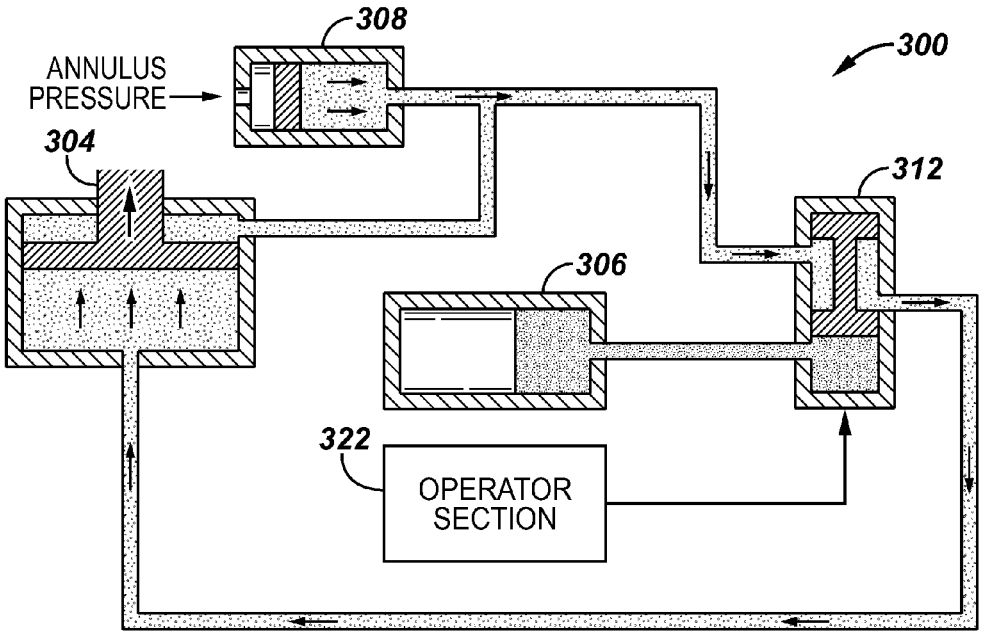
FIG. 6 is a schematic diagram of a hydraulic circuit of the circulating valve tool of FIG. 5 when the tool is in a first state.
Figure 7:
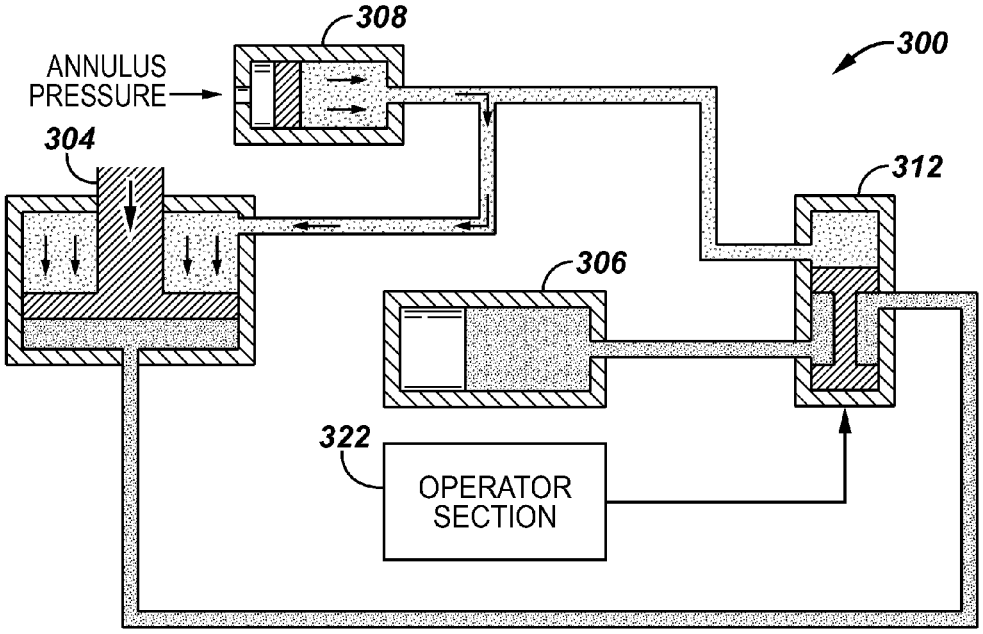
FIG. 7 is a schematic diagram of a hydraulic circuit of the valve of FIG. 5 when the tool is in a second state.

Operation of the tool 300 may be better understood with reference to FIGS. 6 (depicting the power piston 304 at its uppermost position of travel) and 7 (depicting the power piston 304 at its lowermost position of travel). Referring to FIG. 6, annulus pressure is always applied to an upper chamber that is communication with an upper face of the power piston 304. The lower face of the piston 304, in turn, is connected either to the dump chamber 306 or to the hydrostatic chamber 308, as depicted in FIG. 6. When an operator section 322 (that contains the piston 324) configures the pilot valve 312 to connect the lower chamber to the hydrostatic chamber 308, the power piston 304 moves upwardly, as depicted in FIG. 6. As depicted in FIG. 7, when the operator section 322 configures the pilot valve 312 to connect the lower chamber to the dump chamber 306, then the power piston 304 moves to the lower position as depicted in FIG. 7. It is noted that the number of up and down cycles to effect a transition of the power piston 304 is controlled by the capacity of the dump chamber 306.

While the present disclosure has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present disclosure.

What is claimed is:

1. A tool usable with a well, comprising:

a valve element having a first state and a second state;

a first mechanical operator, comprising a piston having a first face and a second face;

a pilot valve to control communication of an annulus pressure to the first mechanical operator; and a second mechanical operator to respond to annulus pressure to control operation of the pilot valve, wherein the second mechanical operator is adapted to cause pilot valve to communicate the annulus pressure to the first face of the first mechanical operator to cause the first mechanical operator to transition the valve element from the first state to the second state in response to the annulus pressure exhibiting a predetermined signature, and communicate the annulus pressure to the second face of the first mechanical operator and block communication of the annulus pressure to the first faceoff the first mechanical operator to cause the first mechanical operator to transition the valve element from the second state to the first state, wherein annulus pressure is continuously applied to the second face of the first mechanical operator.

2. The tool of claim 1, further comprising:

a dump chamber to receive fluid from the first mechanical operator in response to the transition of the second mechanical operator from the second state to the first state.

3. The tool of claim 1, further comprising:

a compensator to transfer pressure from the annulus and isolate the annulus fluid from the second mechanical operator.

4. The tool of claim 1, wherein the valve element comprises a circulation valve element.

5. A method comprising:

operating a pilot valve to communicate annulus pressure to a first face of a mechanical operator to cause the first mechanical operator to transition a valve element from a first state to a second state in response to the annulus pressure exhibiting a first predetermined signature; and using the pilot valve to block the communication of the annulus pressure to the first face of the mechanical operator and to direct the annular pressure to a second face of the first mechanical operator to cause the first mechanical operator to transition the valve element from the second state to the first state in response to the annulus pressure exhibiting a second predetermined signature, wherein annulus pressure is always applied to the second face of the first mechanical operator.

6. The method of claim 5, further comprising:

receiving fluid from the first mechanical operator in a dump chamber in response to the transition of the second mechanical operator from the second state to the first state.

7. The method of claim 5, further comprising:

transferring pressure from the annulus and isolating the annulus fluid from the second mechanical operator.

8. The method of claim 5, wherein the valve element comprises a circulation valve element.

9. A tool usable with a well, comprising:

a valve element having a first state and a second state;

a first mechanical operator;

a pilot valve in communication with the valve element, the pilot valve having at least a first position and a second position;

a second mechanical operator in communication with the pilot valve and operative to selectively place the pilot valve in one of the first position or second position;

a hydrostatic chamber in communication with the pilot valve; and a dump chamber in communication with the pilot valve;

wherein the hydrostatic chamber is always in communication with a volume of the first mechanical operator and, when the pilot valve is in a second position the hydrostatic chamber is in communication with a second volume of the first mechanical operator and the dump chamber is in communication with the first volume of the first mechanical operator.

10. The tool of claim 9, wherein the mechanical operator is configured to respond to a predetermined signature in an annulus pressure relative to a baseline level of the annulus pressure to transition the valve element from the first state to the second state, the baseline level capable of varying over time, wherein further the predetermined signature comprises a momentary increase in the annulus pressure above the baseline level.

11. The tool of claim 9, wherein the tool comprises:

a first gas chamber to store a gas; and a compensator to isolate the gas from fluid in the annulus and communicate the predetermined signature to the first gas chamber.

12. The tool of claim 11, further comprising:

a second gas chamber, wherein the mechanical operator comprises a piston to travel between an upper position and a lower position in response to a differential between a pressure exerted by the gas stored in the first gas chamber and a pressure in the second gas chamber.

13. The tool of claim 12, wherein the mechanical operator further comprises:

a pressure equalizer to bleed gas between the first and second gas chambers to equalize the pressure in the first and second gas chambers in response to the pressure differential.

14. The tool of claim 13, wherein the pressure equalizer is adapted to accelerate equalization of the pressures in the first and second chambers in response to the second piston nearing the first position or the second piston nearing the second position.

15. A method usable with a well, comprising:

responding to a predetermined signature in an annulus pressure relative to a baseline level of the annulus pressure to transition a pilot valve from a first position to a second position;

exerting a hydrostatic pressure via the pilot valve in a first position to bias a valve element to transition from a second state to a first state, and continuing to exert the hydrostatic pressure;

regulating the chamber pressure based on the baseline level;

preventing the valve element from transitioning from the first state to the second state until a predetermined number of pressurization cycles occur in the well, the preventing comprising restricting travel of the mechanical operator using an indexer;

placing the pilot valve in the second position; and basing the valve element to transition to the second state from the first state when the pilot valve is in the second position at least in part by exerting hydrostatic pressure.

16. The method of claim 15, wherein the predetermined signature comprises a momentary increase in the annulus pressure above the baseline level.

17. The method of claim 15, wherein the act of regulating comprises regulating the chamber pressure to track the baseline level.

18. The method of claim 15, further comprising:

bleeding gas between a first chamber that exerts the chamber pressure and a second chamber to equalize the pressure in the first and second chambers in response to a pressure differential between the first and second chambers.

* * * * *